US006210762B1

(12) United States Patent
Pielow

(10) Patent No.: US 6,210,762 B1
(45) Date of Patent: Apr. 3, 2001

(54) ORNAMENTAL DISPLAY

(76) Inventor: Graham Pielow, c/o CCG International Ltd., Claybrook Dr., Washford, Redditch B98 ODT (GB)

( * ) Notice: Subject to any disclaimer, the term of this patent is extended or adjusted under 35 U.S.C. 154(b) by 0 days.

(21) Appl. No.: 09/394,801

(22) Filed: Sep. 10, 1999

(30) Foreign Application Priority Data

Sep. 12, 1998 (GB) ..... 9819843

(51) Int. Cl.[7] ..... A47G 33/04

(52) U.S. Cl. ..... 428/7; 428/18; 428/542.2; 446/73; 446/175; 40/411

(58) Field of Search ..... 428/7, 18, 542.2; 446/73, 175, 297, 298; 40/411, 414, 417, 427; 472/137

(56) References Cited

U.S. PATENT DOCUMENTS 3,512,298 5/1970 Poynter .
4,209,938 7/1980 Orenstein ..... 46/116

FOREIGN PATENT DOCUMENTS

0264296 * 4/1988 (EP) .
2 277 279 3/1994 (GB) .

* cited by examiner

*Primary Examiner*—Deborah Jones
*Assistant Examiner*—Abraham Bahta
(74) *Attorney, Agent, or Firm*—Andrus, Sceales, Starke & Sawall, LLP

(57) ABSTRACT

An ornamental display such as an artifical christmas tree has a conical hollow body which is externally ornamented and closed by a pair of side-hinged doors. An ornamental scene is housed within the hollow body and is viewable when the doors are open. A sound and/or motion sensor is provided for automatically operating a motor for opening the doors which are spring-biassed into the closed position in which the ornamental scene is hidden from view.

6 Claims, 2 Drawing Sheets

ORNAMENTAL DISPLAY

BACKGROUND OF THE INVENTION

This invention relates to an ornamental display and is more particularly, though not exclusively, concerned with an ornamental display for use around the christmas period.

BRIEF SUMMARY OF THE INVENTION

According to the present invention, there is provided an ornamental display comprising a hollow body which is externally ornamented, an ornamental scene within the hollow body, at least one door in the hollow body, said at least one door being movable between a relatively closed position in which the ornamental scene is substantially hidden from view and a relatively open position in which the ornamental scene is exposed to view, and electrically actuable means for moving said at least one door between its open and closed positions.

Preferably, the ornamental scene is a scene which is caused to be animated when said at least one door is opened.

Conveniently, said at least one door is side-, top- or bottom-hinged and may be spring-biassed into either of its positions, preferably its closed position.

In a particularly preferred embodiment, the electrically actuable means includes a movement and/or sound sensor which causes said at least one door to open when the sensor senses sound and/or movement in the vicinity of the display.

Said at least one door may be operable by means of an electric actuator such as an electric motor or a magnet and moveable armature assembly via any suitable linkage such as a lever system, a gear system, a cam and can follower system, or a cord/band and pulley system.

In a particularly convenient embodiment, the ornamental hollow body is of conical shape and more preferably takes the form of an artificial christmas tree. In such a case, it is preferred for the hollow body to be mounted on a base which takes the form of a tree trunk and/or a pot in which the artificial tree is "potted".

BRIEF DESCRIPTION OF THE DRAWINGS

An embodiment of the present invention will now be described, by way of example, with reference to the accompanying drawings, in which.

DETAILED DESCRIPTION OF THE INVENTION

Figure 1:
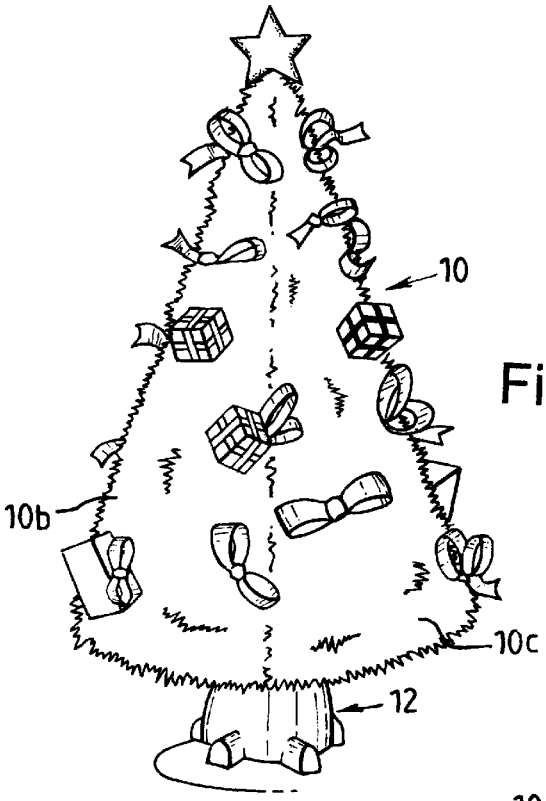
FIG. 1 and 2 are perspective views of one embodiment of ornamental display according to the present invention shown with doors thereof in open and closed positions, respectively.
Figure 2:
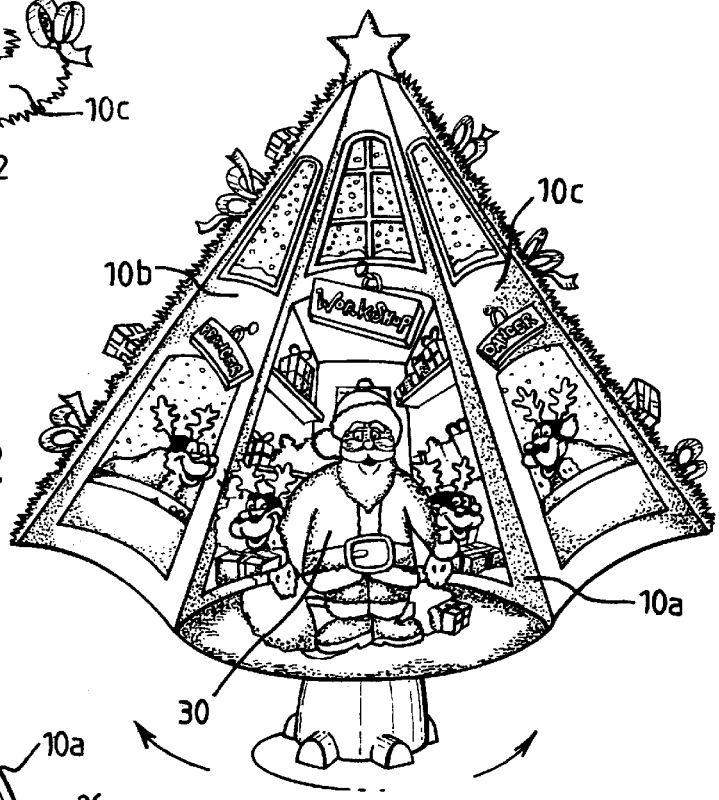
Figure 3:
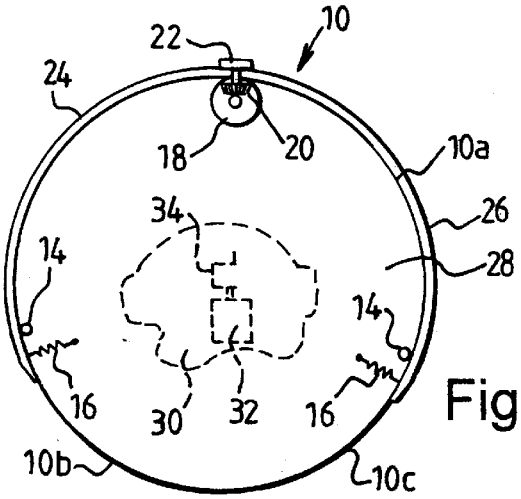
FIG. 3 is a schematic plan view of the display of FIGS. 1 and 2.

Referring now to FIGS. 1 to 3 of the drawings, the ornament display in this embodiment takes the form of an artificial christmas tree and comprises a conical hollow body 10 externally ornamented so as to simulate a decorated christmas tree, and a decorative base 12 simulating the trunk of the christmas tree. The hollow body 10 comprises a fixed, curved, rear wall portion 10*a* and a pair of side-hinged doors 10*b* and 10*c* hingedly connected to opposite peripheral ends of the wall portion 10*a* by means of sets of hinges 14. The doors 10*b* and 10*c* are pivotable about the sets of hinges 14 between a closed position (FIG. 1) in which, together with the rear wall portion 10*a*, they define the conical shape of the body 10, and an open position (FIG. 2) in which the interior of the hollow body 10 is exposed to view. Each door 10*b*, 10*c* is biassed into its closed position by means of a respective spring 16 but is moveable into its open position by means of an electric motor 18. The motor 18 powers the doors 10*b* and 10*c* via a bevel gear 20 which drives a pulley 22 around which operating cords 24 and 26 are wound. The cords 24 and 26 are connected to the respective doors 10*b* and 10*c* so that rotation of the motor 18 in one direction causes the cords 24 and 26 to be tensioned and thereby to open the doors against the action of the springs 16. Rotation of the motor 18 in the opposite direction releases the tension on the cords 24 and 26 and permits the doors 10*b* and 10*c* to move into their closed position under the action of the respective springs 16. A limit switch arrangement (not shown) is provided for stopping the motor 18. The manner in which the motor 18 is energised will be described hereinafter.

Instead of being operated by a cord and pulley system, the doors 10*b* and 10*c* may be operated by a rotary cam and cam follower system mounted in the base 12, the cam followers being mounted at the bottom edges of the respective doors.

The interior surfaces of the doors 10*b* and the rear wall portion 10*a* are provided with a decorative scene thereon, in this embodiment Santa's Workshop.

The hollow body 10 has a floor 28 by which it is supported on the base 12. Centrally mounted on the floor 28 is an animated feature 30 of the decorative scene within the hollow body 10. In this embodiment, the animated feature consists of Santa Claus and two reindeer whose mouths and eyes are moveable by means of a further electric motor 32 via a crank mechanism 34 and linkage (not shown).

Figure 4:
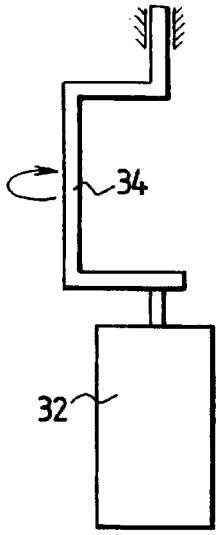
FIG. 4, 5, 6 and 7 are diagrammatic view illustrating various possible forms of drive for animating an internal scene in a decorative display according to the present invention.

Such a crank mechanism is shown in slightly greater detail in FIG. 4.

Figure 5:
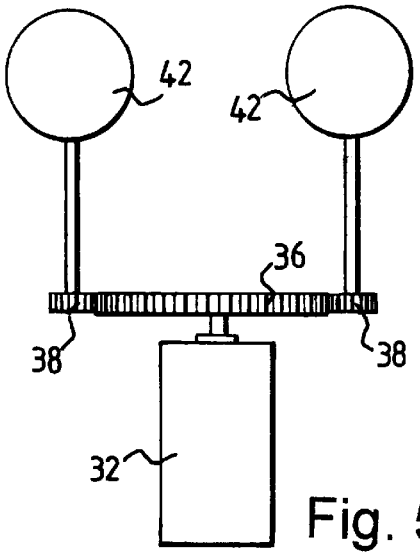

In FIG. 5, an alternative arrangement is shown where motor 32 drives a gear wheel 36 connected to two smaller gear wheels 38 driving respective rotary shafts 40 upon which FIGS. 42 forming part of an animated internal decorative scene are mounted so as to be rotable.

Figure 6:
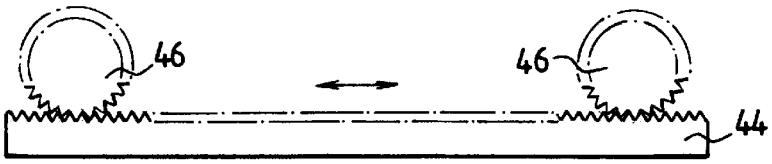

In FIG. 6, an arrangement of rack 44 and pinions 46 provides an alternative mechanism for operating animated features of the internal decorative scene.

Figure 7:
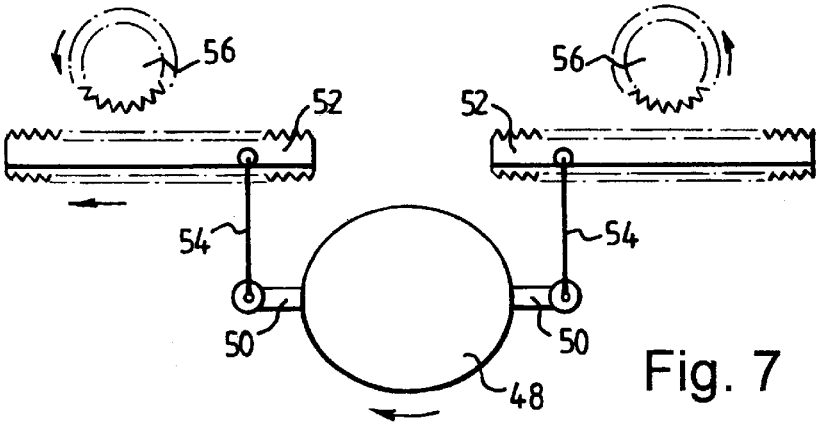

In FIG. 7, motor 32 drives a cam wheel 48 with moveable cam followers 50 driving individual racks 52 via links 54. Individual pinions 56 engage with the respective racks 52 so that the teeth can be oscillated about their respective axes of rotation.

Figure 8:
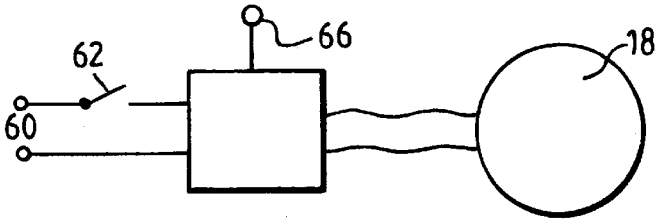
FIG. 8 is a schematic view of a control circuit for a door-operating motor in an ornamental display according to the present invention.

In FIG. 8, a control system is illustrated for controlling actuation of the motor 18. A low voltage power supply of battery 50 is connected via an on-off switch 62 with a control unit 64. The control unit 64 includes a movement sensor 66 or a sound sensor 66, either being of a type known per se. The sensor 66 is mounted at an appropriate location (e.g. on the base 12) so as to pick up sound or movements in the vicinity of the ornamental display. Sound or movement picked up by the sensor 66 results in the control unit 64 causing the motor 18 to be energised for a predetermined period of time. If desired, the electrical supply to the motor 32 may be effected via a switch associated with either of the doors 10*b* and 10*c* such that opening of the appropriate door causes the motor 32 to be energised.

What is claimed is:

1. An artificial Christmas tree comprising a conical hollow body which is externally ornamented to simulate a decorated Christmas tree, an ornamental scene within the hollow body, at least one door in the hollow body, said at least one door being decorated and being moveable between a relatively closed positions in which the ornamental scene is substantially hidden from view and a relatively open position in which the ornamental scene is exposed to view, and electrically actuable means for moving said at least one door between its open and closed positions.

2. An artificial Christmas tree as claimed in claim 1, wherein the electrically actuable means includes a movement and/or sound sensor which causes said at least one door to open when the senor senses movement and/or sound in the vicinity of the tree.

3. An artificial Christmas tree as claimed in claim 1, wherein the ornamental scene is a scene which is caused to be animated when said at least one door is opened.

4. An artificial Christmas tree as claimed in claim 1, wherein said at least one door is hinged door and is resiliently biased into either of its positions.

5. An artificial Christmas tree as claimed in claim 4, wherein said at least one door is resiliently biased into its closed position.

6. An artificial Christmas tree as claimed in claim 1, wherein said at least one door is operable by means of an electric actuator.

* * * * *